United States Patent [19]

San Filipo

[11] Patent Number: 4,881,507

[45] Date of Patent: Nov. 21, 1989

[54] FUEL SUPPLY MECHANISM FOR AN INTERNAL COMBUSTION ENGINE

[76] Inventor: Frank J. San Filipo, P.O. Box 536, Lakeville, N.Y. 14480

[21] Appl. No.: 140,400

[22] Filed: Jan. 4, 1988

[51] Int. Cl.[4] ..... F02M 17/26

[52] U.S. Cl. ..... 123/523; 123/556

[58] Field of Search ..... 123/523, 556

[56] References Cited

U.S. PATENT DOCUMENTS

| | | | |
|---|---|---|---|
| 3,411,489 | 11/1968 | Kruger | 123/523 |
| 4,366,797 | 1/1983 | Jackson et al. | 123/523 |
| 4,368,712 | 1/1983 | Jackson et al. | 123/523 |
| 4,370,970 | 2/1983 | Kunz | 123/523 |
| 4,386,593 | 6/1983 | Tibbs | 123/523 |
| 4,397,286 | 8/1983 | Jackson et al. | 123/523 |
| 4,399,794 | 8/1983 | Gagnon | 123/523 |

*Primary Examiner*—E. Rollins Cross

*Attorney, Agent, or Firm*—Lawrence P. Kessler

[57] ABSTRACT

A fuel supply mechanism for an internal combustion engine having a plurality of chambers, such mechanism providing for optimum efficiency of fuel consumption. The fuel supply mechanism according to this invention comprises a remote fuel supply reservoir. Fuel from the remote reservoir is evaporated in the reservoir, and the evaporated fuel is entrained in an air flow and transported directly into the intake chamber for the engine combustion chambers.

9 Claims, 2 Drawing Sheets

FUEL SUPPLY MECHANISM FOR AN INTERNAL COMBUSTION ENGINE

BACKGROUND OF THE INVENTION

This invention relates in general to fuel supply mechanisms for internal combustion engines, and more particularly to a fuel supply mechanism where fuel is vaporized in a remote reservoir for use in an internal combustion engine.

For years fuel has been supplied to the standard internal combustion engine by a carburator which mixes raw fuel pumped from a fuel supply tank with air. The fuel-/air mixture is then sucked into the combustion chambers and ignighted by a spark to create the required combustion reaction necessary to power the engine. It has long been recognized that the carburator does not provide for an efficient utilization of the fuel.

With the rapid rise in fuel prices it has become necessary to develop improved mechanisms for getting fuel to the combustion cylinders in a manner which provides for a more efficient use of the fuel. Recent efforts to improve fuel economy have resulted, for example, in the development of a direct fueld injection engine which eliminates the carburator. In such system, pressurized fuel is delivered to injectors which aspirate the fuel into an air stream for delivery to the combustion chambers. Since the fuel aspiration is capable of a more finite control, fuel consumption efficiency is markedly improved. However, a relatively significant portion of the fuel still does not burn in the combustion chambers to provide motive energy and is therefore wasted. Thus fuel consumption efficiency is not optimized by the fuel injection system.

SUMMARY OF THE INVENTION

This invention is directed to a fuel supply mechanism for an internal combustion engine having a plurality of chambers, such mechanism providing for optimum efficiency of fuel consumption. The fuel supply mechanism according to this invention comprises a remote fuel supply reservoir. Fuel from the remote reservoir is evaporated in the reservoir, and the evaporated fuel is entrained in an air flow and transported directly into the intake chamber for the engine combustion chambers.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
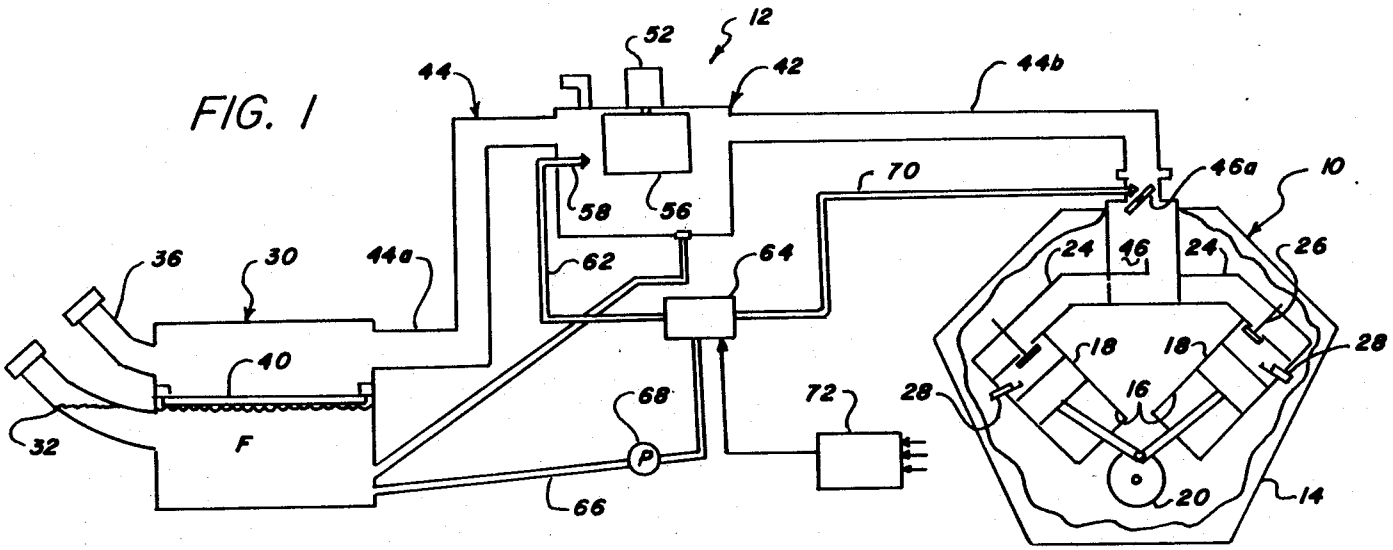
FIG. 1 is a schematic illustration of an internal combustion engine and an associated fuel supply mechanism according to this invention.

Referring now to the accompanying drawings, FIG. 1 schematically shows an internal combustion engine 10, and an associated fuel supply mechanism, designated generally by the numeral 12, according to this invention. The internal combustion engine 10 has a block 14 containing a plurality of combustion cylinders 16 (two shown) in which pistons 18 respectively reciprocate to rotate a drive shaft 20 in a well known manner. The cylinders 16 communiate with a fuel mixture intake chamber 46 via fuel mixture conduits 24 which respectively run from the chamber 46 to each of the cylinders. Ports 22 in the cylinders 16, respectively controlled by valves 26, allow the fuel mixture to be delivered to the respective cylinders at appropriate times. Each cylinder has a spark plug 28 associated therewith for ignighting the fuel mixture within the cylinders to create the controlled explosion for propelling the pistons 18 to rotate the drive shaft 20. While the engine 10 is shown as being of the type in which the cylinders are in a V-shaped orientation, the fuel supply mechanism 12 according to this invention is suitable for use with other engine configurations and cylinder orientations, such as in-line or opposed for example. Moreover, while it is intended that the engine 10 is to be used as the motive source for a pasenger carrying vehicle, it is of course understood that the engine could suitably be used for many other applications.

Controlled, efficient feeding of the fuel mixture to the engine 10, is provided by the fuel supply mechanism 12 according to this invention. The mechanism 12 includes a remote reservoir 30 adapted to contain a primary supply of fuel F. A first inlet conduit 32, connected to the reservoir 30, enables fuel to be added to the reservoir when the cap 34 is removed from the access end of such first conduit. A second conduit 36 is connected to the reservoir 30 for enabling air to be readily drawn into the reservoir and across the fuel supply held therein. The flow of air across the fuel supply causes a portion of the fuel to evaporate into the air stream. The access end of the conduit 36 is covered with a suitable filter 38 to prevent contaminents, for example entrained in the air stream, from entering the reservoir 30. A float 40, formed of a fibrous material for example, separates the fuel-containing portion of the reservoir from the air stream drawn through the reservoir, while enabling the air stream to carry out its evaporation function.

Figure 2:
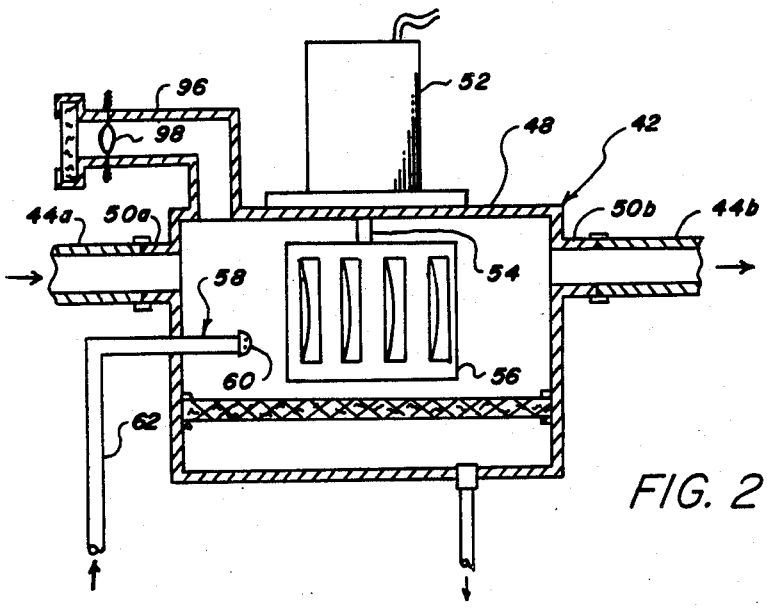
FIG. 2 is a side elevational view, in cross-section and on an enlarged scale, of an evaporated fuel transport assembly for the fuel supply mechanism of FIG. 1.

Propulsion of the air stream to evaporate fuel from the reservoir 30 is provided by an evaporated fuel transport assembly 42, which is shown in more detail in FIG. 2. The assembly 42 is located in conduit 44 which provides flow communication between the reservoir 30 and the intake chamber 46 of the engine 10 and may be positioned anywhere between the remote reservoir and the engine as is convenient. The transport assembly 42 includes a housing 48 having integrally formed bosses **50*a* and 50*b*. A segment 44*a* of conduit 44 connects the remote reservoir 30 to the transport assembly 42 at boss 50*a*, while a segment 44*b* of the conduit 44 connects the intake chamber 46 to the apparatus 42 at the boss 50*b*. A motor 52 is mounted on an external portion of the housing 48. The output shaft 54 of the motor 52 extends into the interior of the housing, through a suitable bearing seal, and is coupled to a centrifugal impeller fan 56. When the fan 56 is activated by the motor 52, air is drawn from the intake 36 across the fuel supply F in the remote reservoir 30 and through conduit segment 44***a* into the interior of the housing 48. As the air flow passes across the the fuel supply F, it evaporates a portion of the fuel so that the resulting air flow is actually a fuel-/air mixture. The fan 56 forces the fuel/air mixture through segment 44*b* of the conduit 44 into the intake chamber 46 of the engine 10, where it is thereafter selectively supplied to the combustion chambers 16 to run the engine. A butterfly valve 46*a* is located in the throat of the chamber 46. The purpose of the valve 46*a* is to automatically seal off the segment 44*b* of conduit 44 in case of engine backfire.

The motor 52 for driving the fan 56 is, for example, a variable speed brushless D.C. motor. This enables the amount of air drawn through the reservoir, and thus the amount of fuel evaporated, to be controlled by varying the motor speed. At the same time, such type motor will not present a danger by creating sparks which could be dangerous as possibly prematurely ignighting the fuel-/air mixture. Under normal operating conditions, the air flow created by the fan 56 and drawn across the fuel supply in the reservoir 30, has been proven to evaporate sufficient quantity of fuel to adequately sustain combustion in the engine combustion chambers 16. Accordingly, the arrangement of the fuel supply mechanism 12 of this invention provides a for a fuel efficiency usage not found in prior fuel supply mechanisms.

The proportions of air and fuel in the mixture supplied to the engine 10 must, of course, be adjustable to accomodate for differing operating conditions, such as cold start-up or when added (less) power is needed for going up (down) hills or passing. To change the fuel/air ratio of the mixture, the transport assembly 42 includes a fuel diffuser 58. The diffuser 58 comprises a ported nozzle 60 located adjacent to the fan 56. If required, the ports for the nozzle 60 may be adjustable in any well known automatic or manual manner. The nozzle is connected via a conduit 62 to an adjustable control valve 64. The valve 64 is, in turn, connected to the remote reservoir 30 through a conduit 66, and through a conduit 70 directly to the intake chamber 46 of the engine 10. A fuel pump 68, located in the conduit 66 pumps fuel from the remote reservoir 30 to the valve 64. The valve 64 is of the two-way type so as to be capable of metering a desired flow of fuel into either of the conduits 62 or 70 for distribution to the nozzle 60 or the engine intake chamber 46 respectively. An intake 96, having a spring-urged butterfly closure valve 98 for example, enables additional air to be drawn into the housing 48 of the assembly 42 if required to alter the ratio of the fuel/air mixture.

As noted above, under certain operating parameters, the fuel supply mechanism 12 must deliver a portion of raw fuel directly to the nozzle 60 or to the engine intake chamber 46. By accurately controlling the opening of the valve 64, the efficiency in fuel utilization can be dramatically improved. This is because, as to raw fuel utilization, only that amount of fuel which is actually needed for particular operating parameters is used, all other fuel requirements being supplied by the mechanism 12 in vaporized form. Control of the valve 64 is accomplished by, for example, an electronic microprocessor based unit 72, which automatically senses engine operating parameters and, according to a program for the microprocessor, appropriately sets the opening of the valve. The architecture for the program is of course a well known skill in the art of microprocessor programing and is dependent upon the particular microprocessor chosen for the unit 72. Of course, the control for the valve 64 can also suitably be accomplished in other well known ways, such as for example by an operator adjustable mechanical linkage coupled to the valve.

Figure 4:
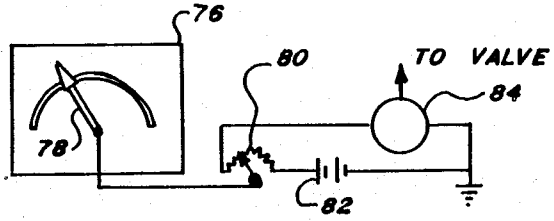
FIG. 4 is a schematic illustration of an alternate embodiment of a control device for the fuel supply mechanism of FIG. 1.

The valve 64 may alternatively be controlled, at least as to the orientation of the engine 10, by an inclinometer 74 shown in FIG. 4. The body 76 of the inclinometer is associated with engine 10 so as to have the same orientation relative to the horizontal as the engine, in the direction of travel of the engine. Therefore, as the orientation of the engine changes (such as when the associated vehicle is going up or down hills), the orientation of the body of the inclinometer will change in a proportional manner. The gauge portion 78 attached to the inclinometer body 76 seeks a vertical orientation when the orientation of the body changes. The portion 78 is coupled to a variable potentiometer 80 which controls the electical potential from an electrical power source 82 to an electrically operated valve adjusting mechanism 84. The mechanism 84 adjusts the valve 64 in an amount proportional to the potential received by the mechanism. Accordingly, depending on the orientation of the inclinometer body, more or less potential is supplied to the mecanism 84 to open or close the valve 64 appropriately.

Figure 3:
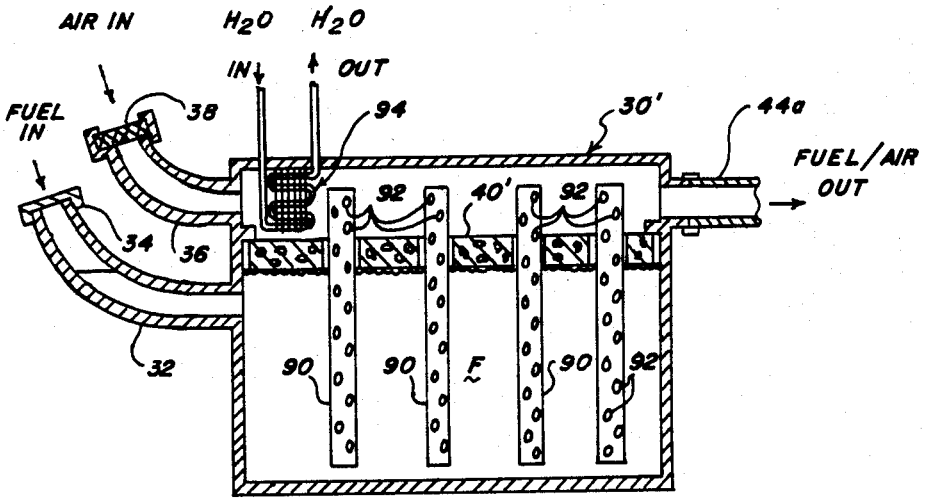
FIG. 3 is a side elevational view, in cross-section and on an enlarged scale, of an alternate embodiment of a remote fuel supply reservoir for the fuel supply mechanism of FIG. 1.

FIG. 3 shows an alternate arrangement, designated generally by the numeral 30', for the remote reservoir of the fuel supply mechanism 12 according to this invention. The remote reservoir 30' has a plurality of tubes 90 arranged within the housing thereof. The tubes 90, which are supported by the fiborous float 40', are respectively filled with a material which acts as a suitable wick for the fuel in the reservoir. Additionally, the tubes have a series of openings 92 through their respective surfaces so that the wick material is exposed to the air flow over the the fuel supply. In this manner, more fuel is exposed to the air flow so as to improve evaporation efficiency. Evaporation efficiency can still further be improved by elevating the temperature of the air stream as it enters the reservoir 30'. Such heating of the air stream is accomplished by passing the air stream over finned heating coils 94 supplied, for example, with engine coolant.

This invention has been described with particular reference to preferred embodiments thereof, but it will be understood that variations and modifications can be effected within the spirit and scope of the invention.

I claim:

1. A fuel supply mechanism for an internal combustion engine having a plurality of combustion chambers, said mechanism comprising:

a remote reservoir adapted to contain a primary supply of fuel;

means, located in said remote reservoir, for evaporating fuel in said remote reservoir into an air stream moving therethrough; and means for transporting said air stream containing such evaporated fuel from said remote reservoir directly into said combustion chambers of said internal combustion engine, said evaporated fuel transporting means including a conduit connected at one end to said remote reservoir and at the opposite end to an intake chamber for said combustion chambers of said engine, a housing located in said conduit intermediate said remote reservoir and said intake for said combustion chambers, and fan apparatus associated with said housing for moving evaporated fuel through said conduit to said combustion chambers.

2. The invention of claim 1 wherein said fuel evaporating means includes means for directing a flow of air through said remote reservoir, over a primary supply of fuel to evaporate a portion thereof and entrain such evaporated fuel in such air flow.

3. The invention of claim 2 wherein said air flow directing means further includes means for heating such air flow prior to directing such air flow through said remote reservoir to improve the evaporation efficiency thereof.

4. The invention of claim 2 wherein said remote reservoir includes at least one wick extending from the supply of fuel into the path of air flow for bringing an increased amount of fuel directly into contact with such air flow.

5. The invention of claim 1 wherein said fan apparatus includes a centrifugal fan having a motor mounted externally of said housing, an output shaft of said motor extending through a wall of said housing into the interior thereof, and an impeller mounted on said output shaft in the interior of said housing.

6. The invention of claim 5 wherein said motor is a variable speed, brushless D.C. motor.

7. The invention of claim 1 further including means for selectively directing a controlled amount of fuel into said housing of said transport means adjacent to said centrifugal fan apparatus and said intake for said combustion chambers of said engine.

8. The invention of claim 7 wherein said selective fuel directing means includes a fuel pump, a first conduit connecting the intake of said fuel pump to said remote reservoir, a fuel metering control valve, a second conduit connecting the output of said fuel pump to said control valve, a third conduit connecting said controll valve to said transport means housing, and a forth conduit connecting said control valve to said intake for said combustion chambers of said engine, and means, responsive to engine operating requirements, for controlling said fuel metering control valve to provide supplemental fuel flow to said transport means housing or said intake for said combustion chambers.

9. The invention of claim 8 wherein said control means includes an inclinometer gauge associated with said engine, said inclinometer gauge being operatively connected to said control valve to set said valve dependent upon the orientation of said engine relative to horizontal.

* * * * *